US005487341A

United States Patent [19]

Newman et al.

[11] Patent Number: 5,487,341

[45] Date of Patent: Jan. 30, 1996

[54] SPIKER WITH HOLE SENSING

[75] Inventors: G. Robert Newman, West Columbia; Edwin H. Reeves, Columbia, both of S.C.

[73] Assignee: Harsco Corporation, Wormleysburg, Pa.

[21] Appl. No.: 265,834

[22] Filed: Jun. 27, 1994

[51] Int. Cl.[6] ..... E01B 29/00

[52] U.S. Cl. ..... 104/17.1

[58] Field of Search ..... 104/17.1, 17.2, 104/2; 209/579, 587; 250/222.1, 234, 334, 561, 562

[56] References Cited

U.S. PATENT DOCUMENTS

| | | | |
|---|---|---|---|
| 3,745,930 | 7/1973 | Dieringer . | |
| 3,753,404 | 8/1973 | Bryan, Jr. | 104/17.1 |
| 3,753,405 | 8/1973 | Bryan, Jr. . | |
| 3,942,000 | 3/1976 | Dieringer | 104/17.1 |
| 4,131,067 | 12/1978 | Newman et al. . | |
| 4,554,624 | 11/1985 | Wickham et al. | 104/17.1 |
| 4,928,600 | 5/1990 | Urmson, Jr. et al. . | |
| 4,947,044 | 8/1990 | Pinson | 250/330 |

OTHER PUBLICATIONS

"Diode Lasers Move Into Machine Vision", Tom Mahony and Jerry Gromala, Lasers & Optronics, Nov. 1989, pp. 69, 70, 72, 73, 75.

*Primary Examiner*—Mark T. Le

*Attorney, Agent, or Firm*—Kerkam, Stowell, Kondracki & Clarke; William L. Feeney

[57] ABSTRACT

A spiker vehicle and associated method of spiking apply a line of laser light which is reflected from a tie plate and imaged by a CCD camera connected to a computer programmed for image recognition by simultaneously determining the locations of two spike holes in the tie plate and the edge(s) of the tie plate, which spike holes are offset in the rail direction. A first spiker is mounted to a carriage which is moved automatically until the first spiker is over one of the sensed holes. The laser and camera are mounted to the spiker for rail direction movement therewith. A second spiker may be mounted to the carriage for spiking spike holes on the opposite side of the rail from the first spiker.

25 Claims, 8 Drawing Sheets

SPIKER WITH HOLE SENSING

BACKGROUND OF THE INVENTION

This invention relates to a spiker vehicle which can sense the location of spike holes in tie plates of a railroad track road bed and an associated method for locating and/or spiking tie plates.

When initially making a railroad track, as well as when repairing a pre-existing railroad track, it is often necessary to use a spiker vehicle. Such a vehicle, which may also bring a rail to proper gauge, inserts spikes into spike holes in the tie plates, thus securing the tie plates to the railroad ties and, in turn, securing the rails to the ties.

Tie plates generally have 4 spike holes on each of two sides, one side being disposed on the field side of a rail and the other side being disposed on the gauge side of the rail. Depending upon the particulars of a given section of the track, one can spike in various patterns using fewer than all 8 spike holes in a given tie plate.

Often spiker vehicles are used which will spike tie plates along the left and right rails of the track at the same time. Such a vehicle generally requires 3 workers on it. Two persons perform the time-consuming task of lining up the spikers (devices which insert spikes into spike holes) with the spike holes and causing the spikers to spike when properly positioned. One of those same persons drives the vehicle along the rails, whereas a third worker loads spikes in the machine for passage in chutes to the various spikers (often 4 spikers, field side and gauge side spikers for each of right and left rails). This is a labor-intensive operation and attempts have been made to automate various aspects of the process for improved productivity.

The following patents are noted:

| Patent No. | Inventor | Issue Date |
|---|---|---|
| 3,745,930 | Dieringer | July 17, 1973 |
| 3,753,404 | Bryan, Jr. | August 21, 1973 |
| 3,753,405 | Bryan, Jr. | August 21, 1973 |
| 3,942,000 | Dieringer | March 2, 1976 |
| 4,131,067 | Newman et al | December 26, 1978 |
| 4,554,624 | Wickham et al | November 19, 1985 |

The two Bryan patents disclose spike driving and positioning systems with an electro-optical device for locating spike receiving holes.

The Dieringer '930 patent shows an automatic hole finder which uses reflective light to automatically drive a spike through a hole. The reflective light is sensed and the hole is located prior to the automatic spiking.

The Dieringer '000 patent shows a device for positioning railway maintenance machines using a laser and an optical receiver to sense the edge of a tie plate. It also indicates that the device may be used as a hole finder for finding spike holes.

The Newman et al patent, co-invented by an inventor herein, discloses a spike driving machine with a hole sensing device.

The Wickham et al patent, assigned to the assignee of the present application, and hereby incorporated by reference, discloses a system for measuring, gauging, and spiking of tie plates.

Although the above and other spiking machines have been used for spiking purposes, the reliability of arrangements to automatically find the spiking holes has been generally unsatisfactory. Indeed, to the knowledge of the present inventors, no company has marketed a spiker vehicle which will automatically find spike holes within a tie plate. Without the ability to automatically find the holes within a tie plate, the spiking process has continued to be relatively labor-intensive since, prior to activating a spiker, a worker must line the spiker up in the proper position just above the spike hole.

OBJECTS AND SUMMARY OF THE INVENTION

Accordingly, it is a primary object of the present invention to provide a new and improved spiker vehicle and associated method of spiking.

Yet another object of the present invention is to provide spiking in a more efficient, quicker, and less labor-intense fashion than prior techniques.

A still further object of the present invention is to provide a very high level of reliability in locating spike holes.

The above and other objects of the present invention which will be apparent from the below description are realized by a spiker vehicle having a vehicle frame with four rail engagement wheels. A first spiker is supported (i.e., directly or indirectly) by the vehicle frame. An actuator is operably connected to the first spiker to move the first spiker in a rail direction. (As used herein, a rail direction simply refers to the direction of movement along the rails of a railroad track.) A hole sensing system is supported by the vehicle frame and operably connected to control the actuator so as to automatically move the first spiker into a spiking position above a spike hole in a tie plate on a tie of the railroad bed. The hole sensing system includes a laser operable to apply a line of light having a sufficient length in a rail direction as to simultaneously illuminate two spike holes offset in the rail direction on a tie plate as well as the edge(s) of the tie plate, a detector for detecting light from the laser as reflected by the tie plate, and a hole recognizer connected to the detector for processing signals from the detector and generating a FOUND signal upon determining the location of one or preferably two spike holes. The detector is preferably a camera with a sufficient field of view to image two spike holes simultaneously. The laser applies the line of light by way of a beam spreader which is operable to produce a fan beam. (As used herein, a fan beam is a beam having a planar shape, extending in a length direction perpendicular to the beam direction at least four times the magnitude of its width, perpendicular to the plane, the length and width being taken where the energy strikes a tie plate.)

The laser and the detector are preferably mounted to move in the rail direction with the first spiker under control of the actuator. The actuator moves the first spiker relative to the vehicle frame. A first lateral positioner is connected to the first spiker for moving the first spiker in a lateral direction perpendicular to the rail direction for selectively spiking spike holes adjacent a rail and spike holes remote from a rail. (The spike holes adjacent a rail are those two holes on either side of a tie plate which are closest to the rail, whereas the remote holes are the other two holes on that side of a tie plate.) The first lateral positioner is operable for moving the laser and the detector in the lateral direction with the first spiker.

The vehicle may further include a carriage support frame mounted to the vehicle frame and a carriage movably mounted to the support frame. The actuator is a carriage positioner for moving the carriage relative to the carriage support frame. The first spiker is movably mounted to the carriage. A first spiker positioner is further included and is connected to the first spiker to move the first spiker relative to the carriage. The vehicle further includes a second spiker movably mounted to the carriage and a second spiker positioner connected to the second spiker to move the second spiker relative to the carriage, the first and second spikers mounted to spike on opposite sides of a rail.

In one embodiment, the vehicle includes a spike button and the FOUND signal triggers a sensory output indicating that a human operator should activate the spike button such that spiking will occur. In an alternate arrangement, the FOUND signal automatically causes the first spiker to spike.

The detector is a camera which images the line of light and the hole recognizer is a computer which identifies where the line of light falls on the holes.

The present invention may alternately be described as a spiker vehicle having a vehicle frame with four rail engagement wheels. A first spiker is supported by the vehicle frame. An actuator is operably connected to the first spiker to move the first spiker in a rail direction relative to the vehicle frame. A hole sensing system is supported by the vehicle frame and operably connected to control the actuator so as to move the first spiker in a spiking position above a spike hole in a tie plate on a tie of a railroad bed. The hole sensing system includes a hole recognizer for generating a FOUND signal upon determining the location of two spike holes offset in the rail direction. The hole sensing system includes a laser operable to apply a line of light having a sufficient length in a rail direction as to simultaneously illuminate two spike holes offset in the rail direction on a tie plate as well as the edge(s) of the tie plate, a detector for detecting light from the laser as reflected by the tie plate, and a computer which identifies where the line of light falls on holes, and generates the FOUND signal upon recognizing the holes.

The method of the present invention is a method of spiking tie plates to ties of a railroad track including the step of moving a hole sensing system of a spiker vehicle to a hole sensing position for sensing holes in a tie plate on a tie. The location of two holes in a tie plate offset in a rail direction are simultaneously sensed by operation of the hole sensing system. A first spiker is automatically moved in the rail direction to line up in a spiking position above one of the two holes sensed by the hole sensing system. That one of the two holes is then spiked (i.e., a spike is driven therein) using the first spiker. Preferably, the simultaneously sensing includes simultaneously illuminating the two holes with a laser. The automatic moving of the first spiker is accomplished preferably by moving the first spiker relative to the spiker vehicle. The automatic moving of the first spiker is more specifically accomplished by moving a carriage on which the first spiker is mounted and on which a second spiker is mounted, the moving of the carriage automatically moving the second spiker into a spiking position lined up above a hole in the tie plate opposite (i.e., separated by the rail therefrom) the two holes which were sensed. In one embodiment, the spiking is performed automatically after the simultaneous sensing and automatically moving steps.

BRIEF DESCRIPTION OF THE DRAWINGS

The above and other features of the present invention will be more readily understood when the following detailed description is considered in conjunction with the accompanying drawings wherein like characters represent like parts throughout and in which.

DETAILED DESCRIPTION

Figure 1:
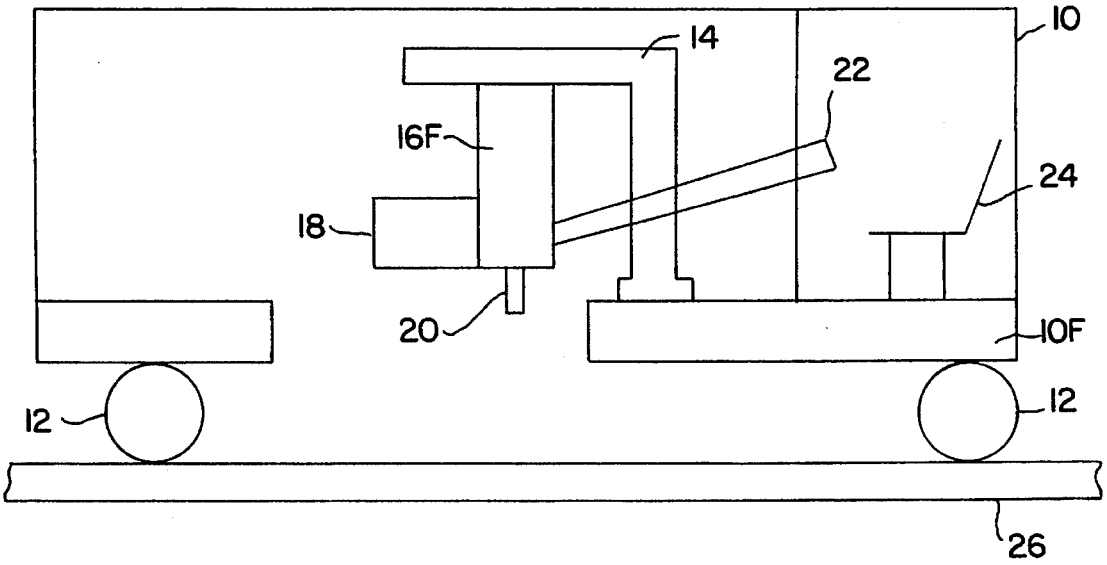
FIG. 1 is a simplified side view of a spiker vehicle according to the present invention.

The simplified schematic side view of FIG. 1 shows a spiker vehicle 10 according to the present invention including a vehicle frame 10F with rail engagement wheels 12 mounted thereon. A carriage frame 14 supports (either directly or indirectly) a first spiker 16F and a box 18 having a hole sensing system, or at least part of such a system, disposed therein. A spike 20 is shown for illustrative purposes, but the details of the spiker 16F are not shown in FIG. 1. A spike chute 22 is illustrated as extending up to adjacent an operator chair 24. Since the operator sitting in chair 24 will be freed from the effort of finding the spike holes within tie plates (not shown in FIG. 1) below rail 26, that person will have sufficient time to feed spikes into the spike chute 22 from which they may travel down to the spiker 16F.

FIG. 1 shows the left side of the vehicle, whereas the preferred embodiment would have corresponding right side components to each of the components illustrated schematically in FIG. 1. Therefore, the vehicle frame 10F would have four such wheels 12 mounted thereon. The operator sitting on either the right or left side of the machine may control the propulsion of the machine along the rails such as rail 26. Accordingly, the spiker vehicle 10 may be operated by two workers, one less than the usual three person crew. Alternately, and depending upon the rate of spiking desired, a single operator might run the machine 10. In that case, the single operator could either feed corresponding right and left side spike chutes 22 or, not shown, a single spike chute which branches off to the two different sides.

Although not shown in FIG. 1, there would preferably be one carriage (two of the spikers on each) on each side of the machine, one spiker spiking the gauge side of the tie plates and the other spiker spiking the field side of the tie plates on each rail.

Figure 2:
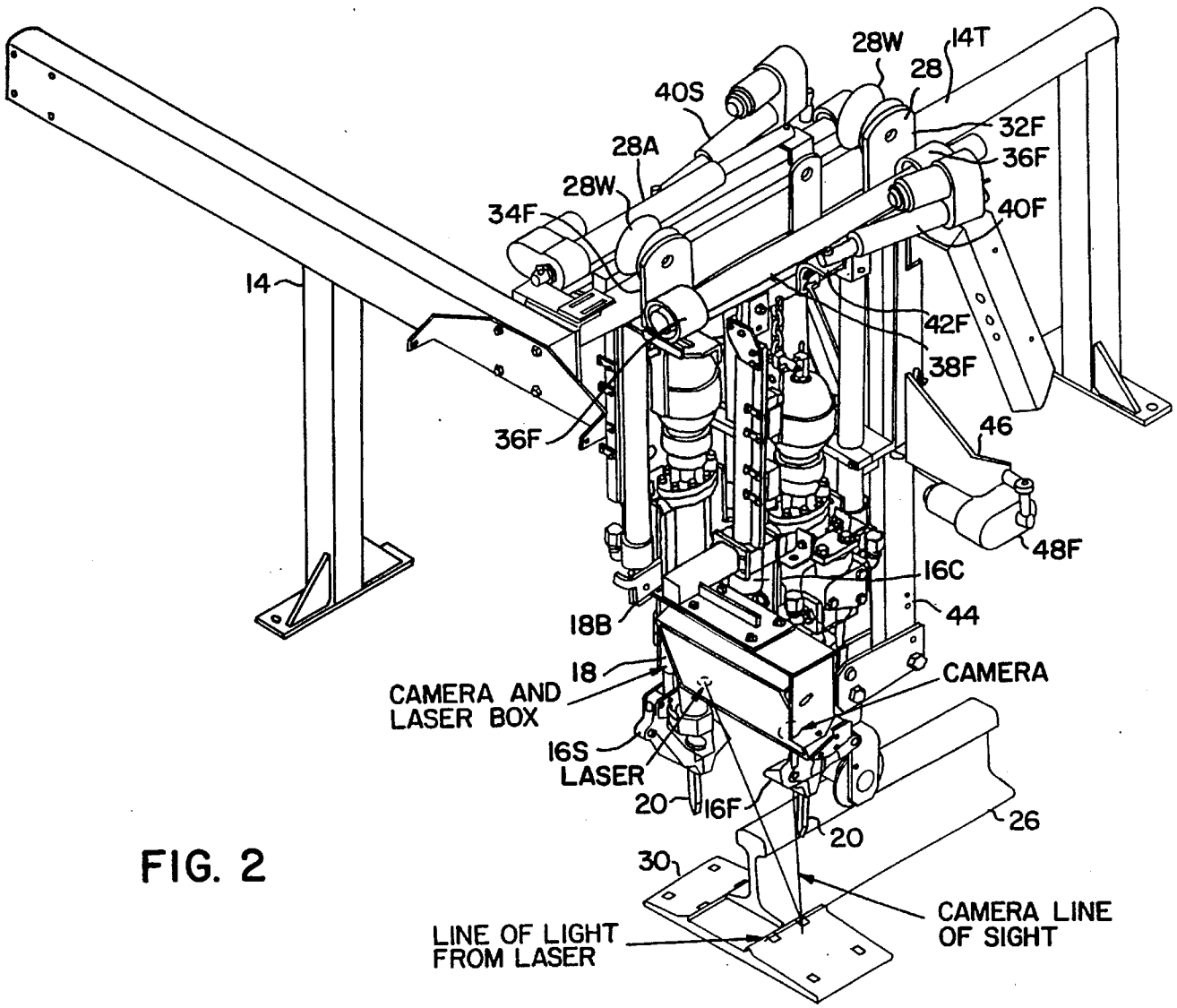
FIG. 2 is a perspective view of a carriage, spikers, and associated parts of the present invention.

Turning now to FIG. 2, the carriage support frame 14, which is fixed to the vehicle frame 10F (not shown in FIG. 2), includes a track portion 14T having a cylindrical curve mating with a concave portion of front and back carriage wheels 28W to allow movement of a carriage 28 under control of a carriage actuator 28A. Since track 14T is parallel to the direction of rail 26, actuator 28A moves the carriage 28 in the rail direction. First and second spikers 16F and 16S respectively are mounted on different sides (field side or gauge side) of the carriage 28. Accordingly, movement of the actuator 28A will move the spikers 16F and 16S in the rail direction. As will be discussed in detail below, the actuator 28A is controlled with a feedback system such that the spikers will be automatically lined up over the spike holes (unlabeled) within the tie plate 30.

The details of the spikers 16F and 16S need not be presented since various known constructions may be used. It will suffice to indicate that each of the spikers 16F and 16S have an arrangement for gripping spikes such as spikes 20 and hydraulically forcing them into spike holes in a tie plate 30.

With the exception of the hole sensing system box 18 and its associated bracket 18B which mounts it to a driving unit lift cylinder 16C of spiker 16F, the structures of spikers 16F and 16S are similar and are similarly mounted on different sides of the carriage 28. Only a single box 18 is needed to line up spiker 16F with one of the holes on one side of the rail (the field side— right side in FIG. 2) of tie plate 30 and the spiker 16S can be readily lined up with one of the holes on the opposite side of the rail (the gauge side—left in FIG. 2) since knowledge of the location of the holes on one side and size of the tie plate readily provides knowledge of the location of the holes on the other side of the rail. As will be discussed below, the box 18 has a laser and camera, both not visible in FIG. 2, for locating hole positions. The box can be mounted to illuminate the field side or gauge side holes—whichever is preferred.

Although only a single box 18 is used for the spikers 16F and 16S associated with rail 26, it should be remembered that another such box for hole sensing and another pair of spikers would be used on the other side of the vehicle for spiking tie plates associated with the other rail, not shown.

The carriage 28 is generally constructed identically on opposite sides of track 14T except that actuator 28A is mounted to only the gauge side of carriage 28. Accordingly, it will be understood that components marked with a suffix of F have a corresponding component on the gauge side opposite the much better shown field side of FIG. 2.

The carriage 28 includes a rear bracket 32F and front bracket 34F, each of which has a cylindrical sleeve bearing 36F mounted thereon to receive a shaft 38F. Spiker 16F hangs from shaft 38F and is moved in the rail direction (i.e., lengthwise direction of rail 26) relative to carriage 28 by first spiker positioner actuator 40F having its cylinder end fixed to front angle bracket 32F and its rod end fixed to bracket 42F, which in turn is fixed to shaft 38F. As positioner 40F extends, shaft 38F and spiker 16F slide leftward in the view of FIG. 2 and parallel to rail 26.

Figure 3:
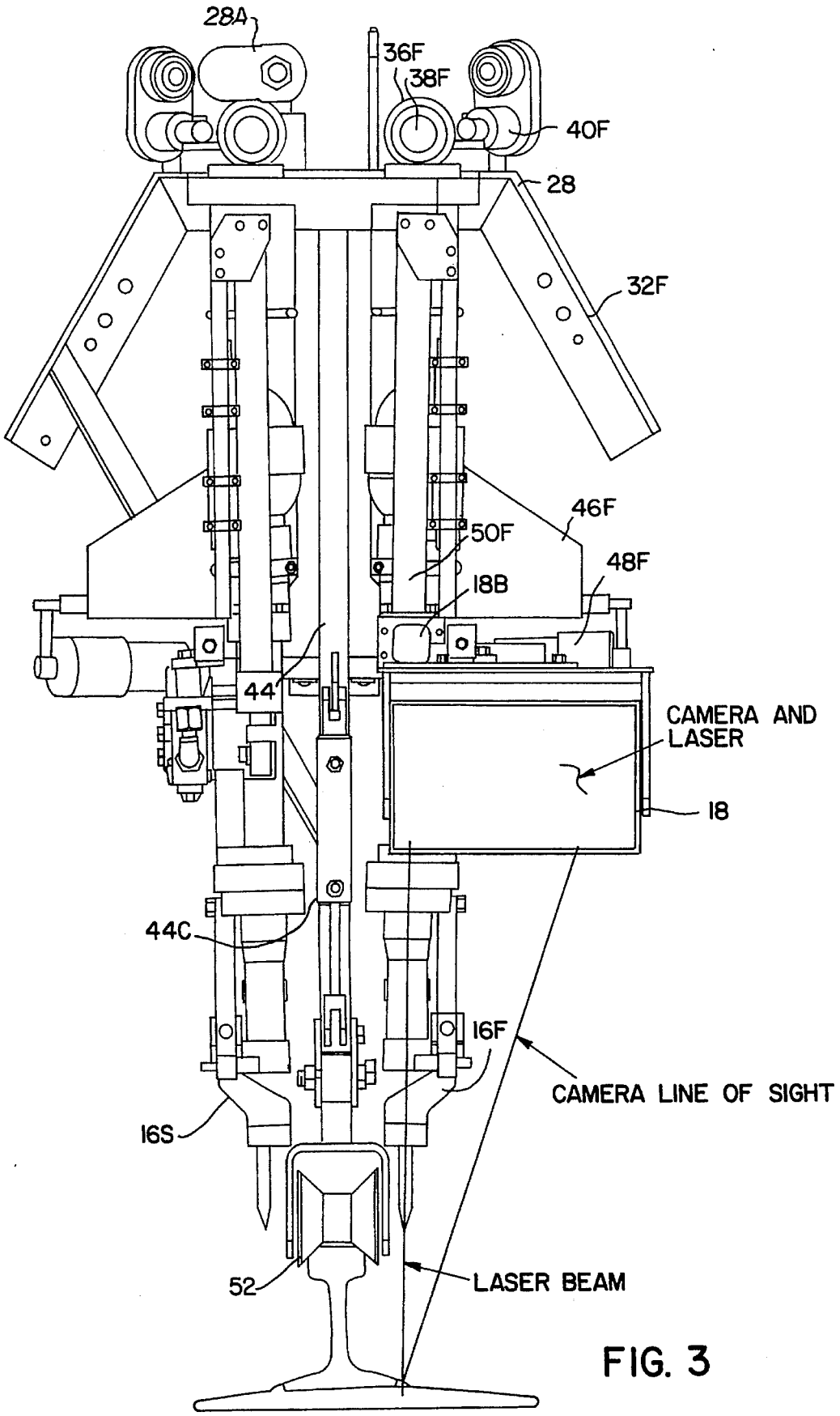
FIG. 3 is a front view of portions of FIG. 2.

A frame member 44 of carriage 28 has a bracket 46 to which one end of a pattern actuator 48F is attached. With reference now also to FIG. 3, the other end of pattern actuator 48F is connected to member 50F of spiker 16F. Extending or retracting the actuator 48F causes spiker 16F to rotate about an axis central to shaft 46F such that spiker 16F may be positioned in line with the holes adjacent the rail (position shown in FIG. 3) or in line with the holes of the tie plate which are remote from the rail 26.

Figure 4:
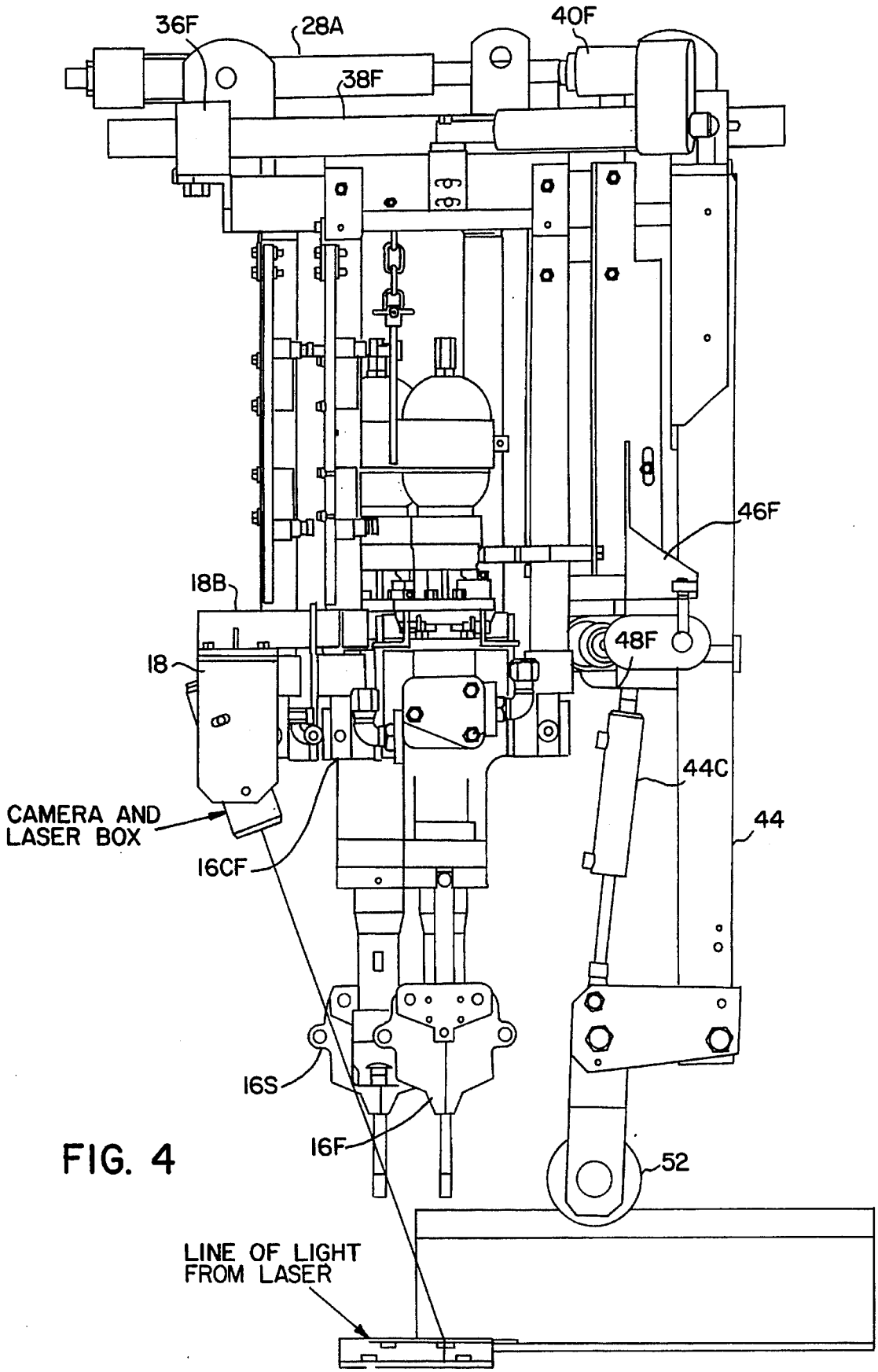
FIG. 4 is a side view of the carriage and spikers of FIGS. 2 and 3.

With reference now to FIGS. 3 and 4, a carriage rail wheel 52 is mounted to member 44 and is movable between a lower, rail engagement position (shown) and an upper inoperative or travel position (not shown) by use of a cylinder or actuator 44C.

Figure 5:
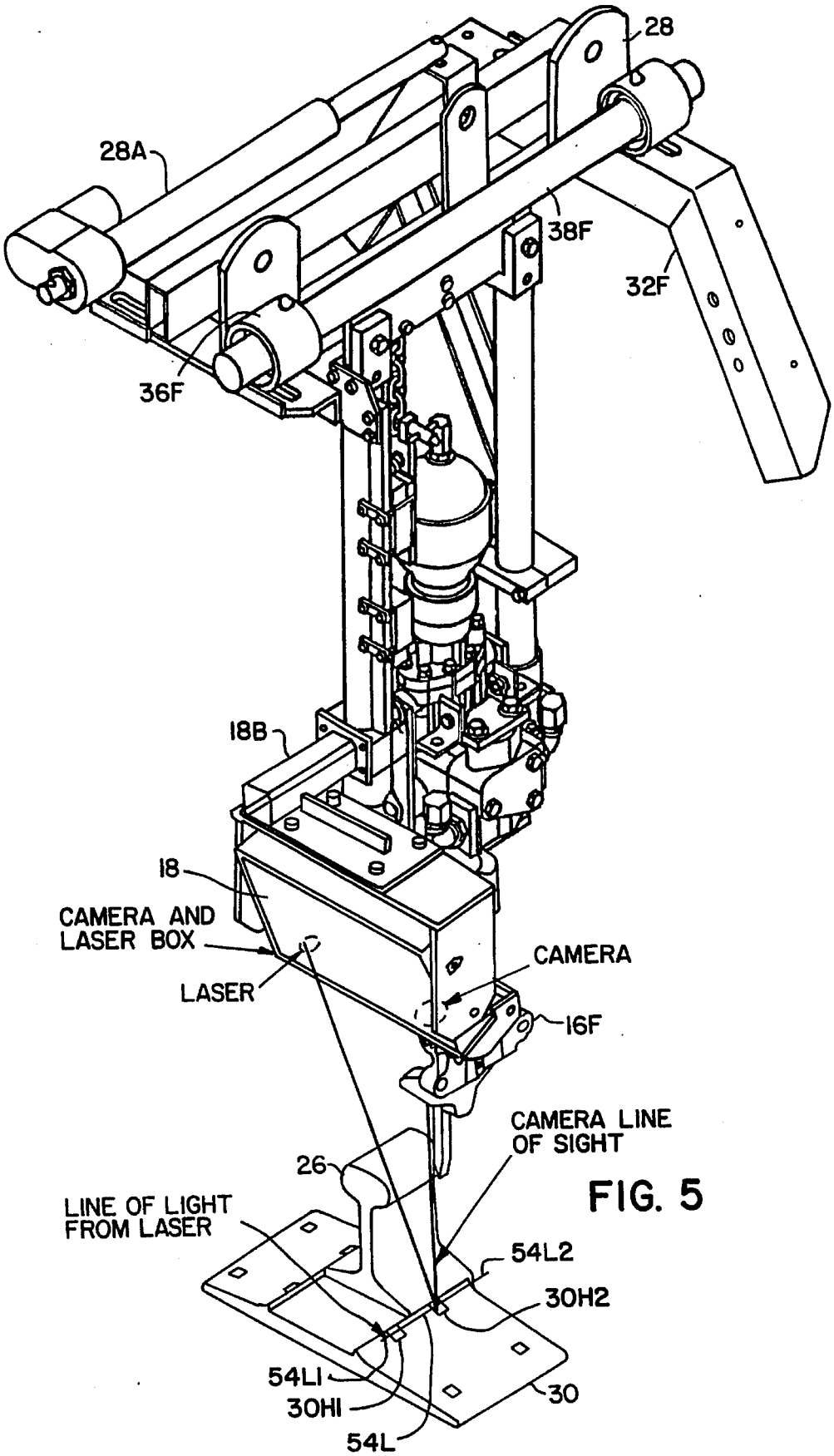
FIG. 5 is a perspective view of portions of the carriage and one spiker.
Figure 6:
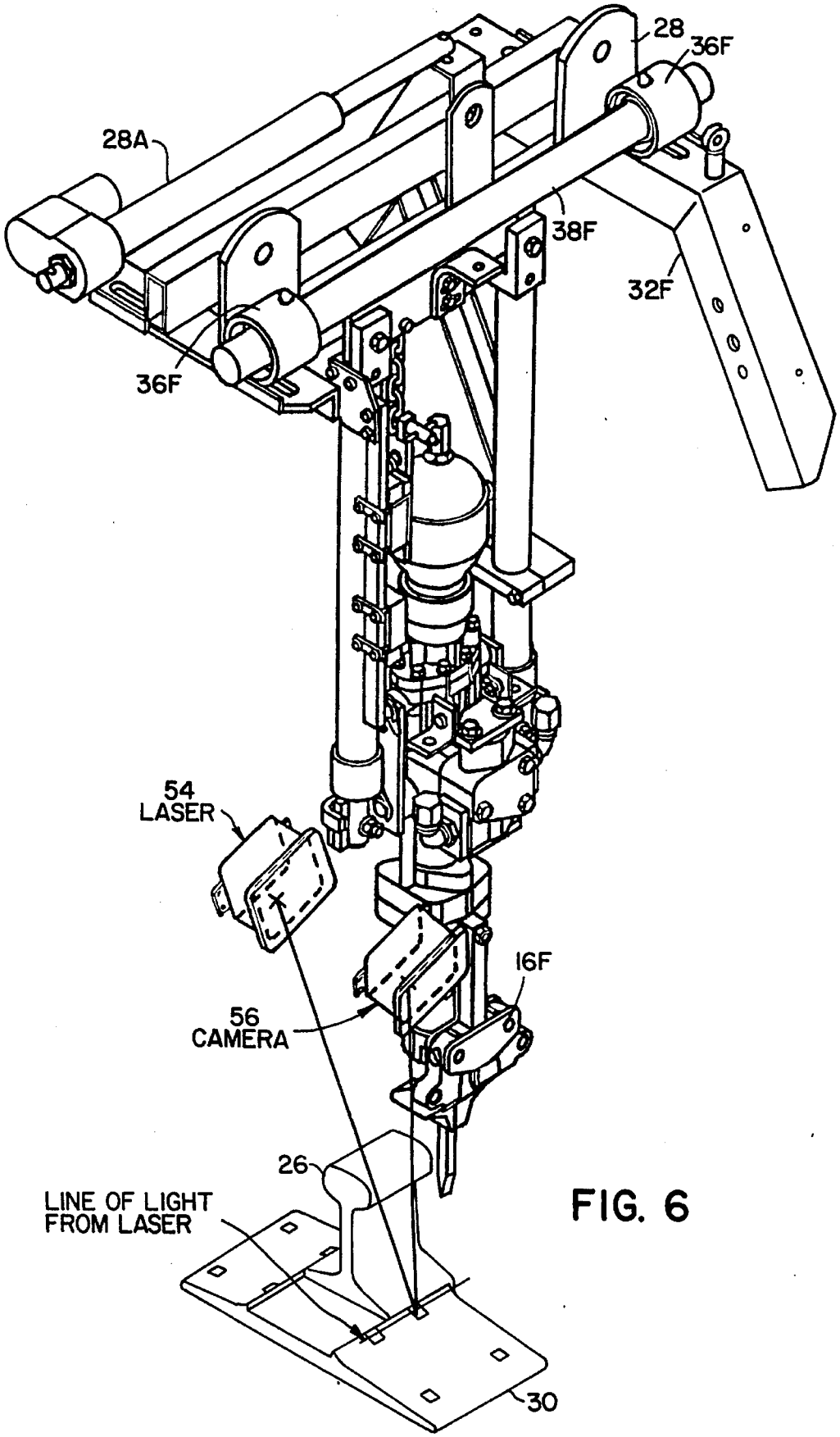
FIG. 6 is a perspective view of portions of the carriage and one spiker with a box removed to show a laser and camera of a hole sensing system.

FIGS. 5 and 6 show views of portions of the carriage 28 with its actuator 28A and the first spiker 16F, various of the other parts being left out for ease of understanding the remaining parts. FIG. 6 is different than FIG. 5 in that the box 18 has been removed in FIG. 6 so that one can see the laser source 54 and CCD camera 56 used therein as part of the hole sensing system according to the present invention. As shown in these FIGS., the laser 54 lays down a line of light 54L on the tie plate 30, which line extends in the rail direction between end points 54L1 and 54L2 over a sufficient distance that both front hole 30H1 and back hole 30H2 are illuminated simultaneously with the edge(s) of the tie plate. (Referring back momentarily to FIG. 2, the line of light is shown as illuminating the two holes offset in a rail direction from each other and on the same side of the adjacent rail 26.) Further, the field of view of video camera 56 is sufficiently large as to simultaneously image both holes 30H1 and 30H2 and the tie plate edge.

Figure 7:
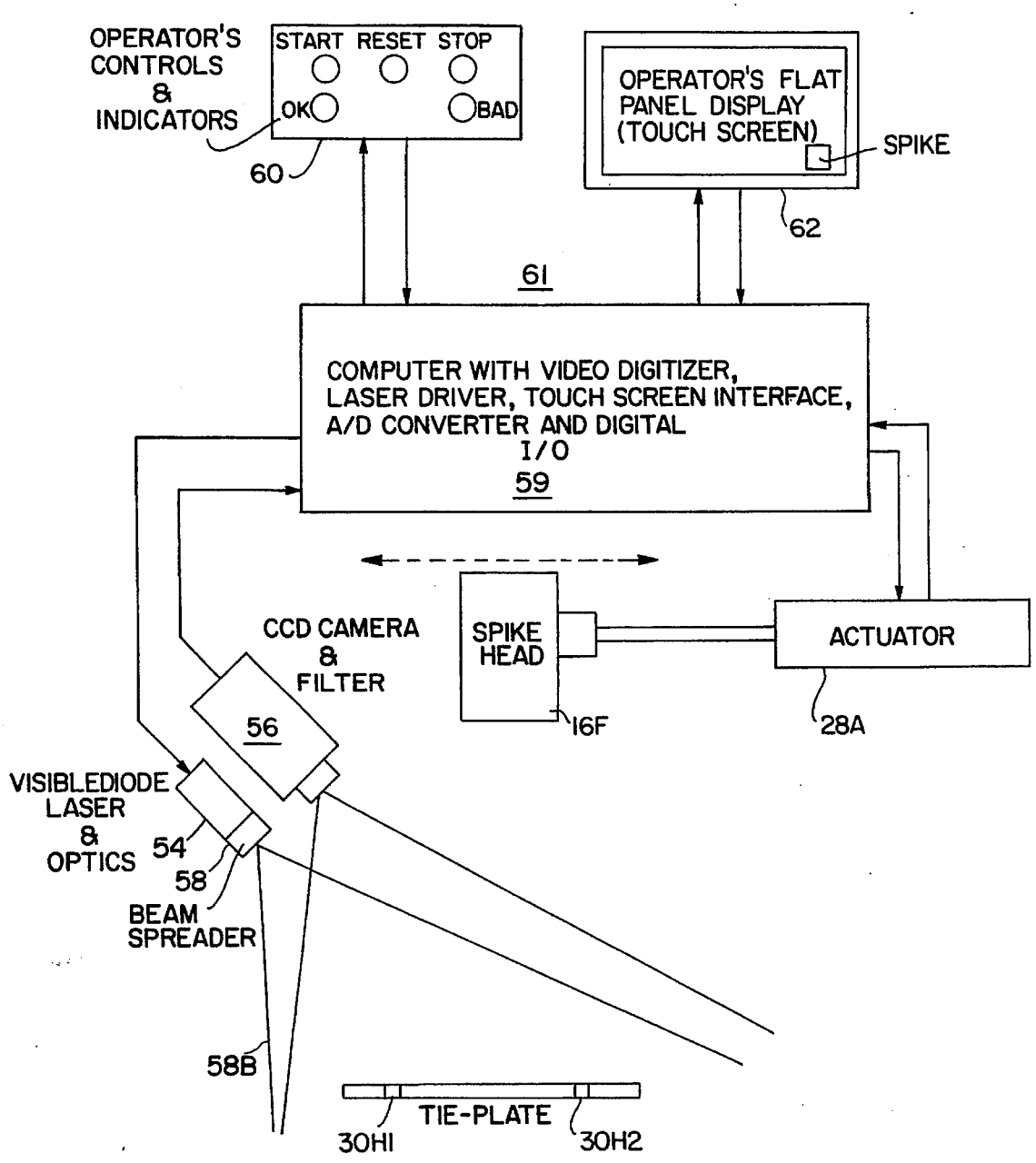
FIG. 7 is a simplified block diagram of the hole sensing system.

Turning now to the simplified block diagram of FIG. 7, there is shown the hole sensing system 61 according to the present invention and including an energy transducer in the form of a laser 54 and associated optics including a beam spreader 58 to produce a fan beam 58B sufficiently long to illuminate holes 30H1 and 30H2 simultaneously with the edge(s) of the tie plate. The camera 56 has a filter, not shown, to minimize light entering the camera other than light corresponding to the wavelength of the laser 54.

The laser 54 and camera 56 are connected to a hole recognizing computer 59, the operation of which will be described in detail below. Connected to the computer are operator control buttons and indicators including a start button (start to look for holes), reset button, stop button (stop looking for holes), OK light (OK to spike), and bad light (stop the spike attempt). A touch screen 62 can be used to input signals to the computer for controlling front/back pattern actuator 40F, lateral pattern actuator 48F (refer back to FIG. 2 momentarily), their corresponding opposite side of rail components and similar pattern actuators for the right side of the vehicle. Such controls allow one to calibrate the spike pattern. For ease of illustration, the various pattern actuators are not shown in FIG. 7. However, a spike button (serving as a spike actuator) is shown and can be activated by an operator switch or computer input device.

The actuator 28A is connected to computer 59 in order to move spike head 16F through feedback control based on the hole location sensed by computer 59 processing the signal from camera 56.

Figure 8:
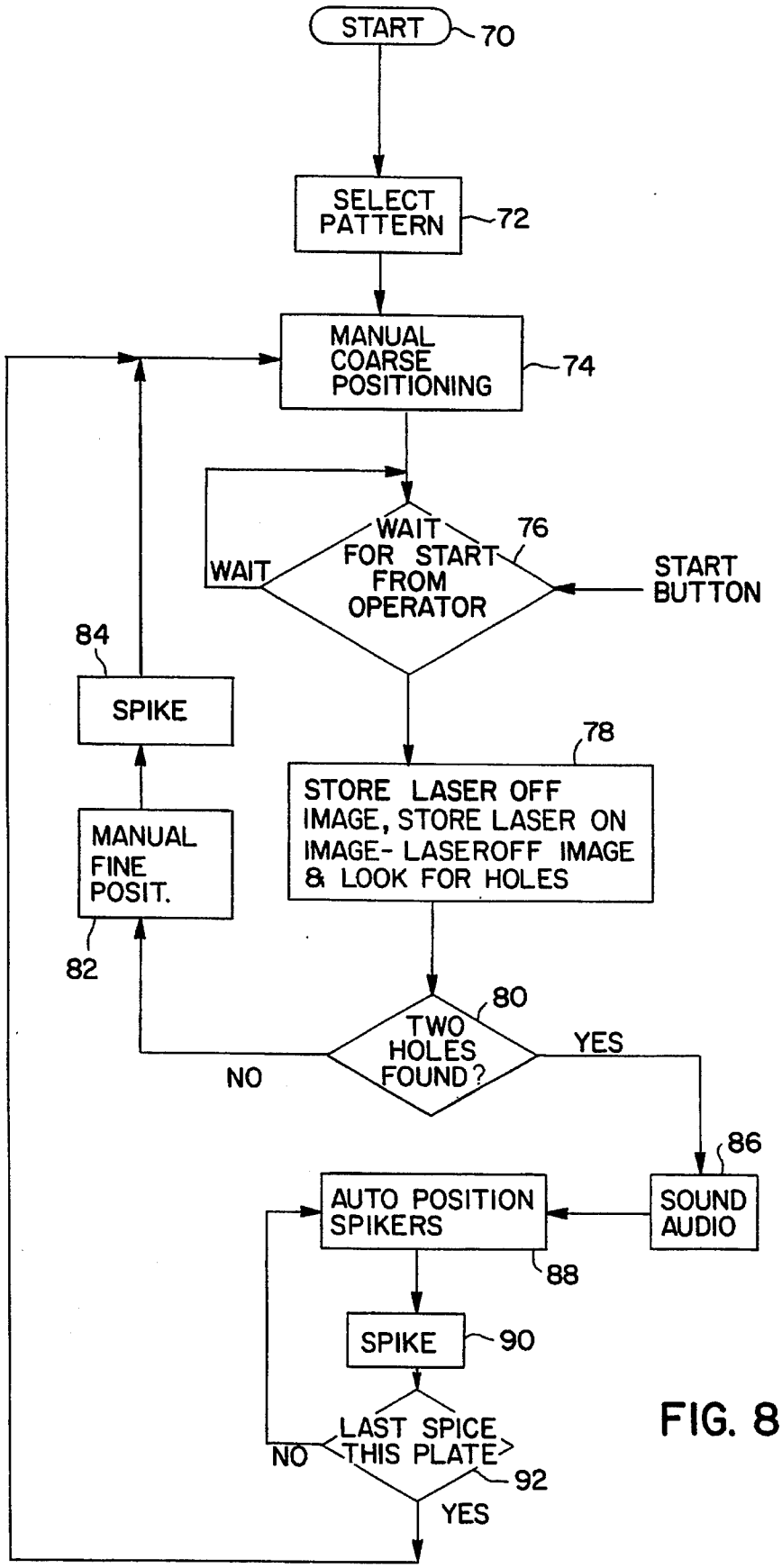
FIG. 8 is a simplified flow chart indicating the process followed by the present invention.

With reference now to FIG. 8, the process used for spiking according to the present invention will be discussed. Reference also will be made to various of the parts illustrated in FIGS. 1, 2, and 7 as appropriate.

Following start block 70, block 72 involves the selection of the spiking pattern, which may be accomplished using the touch screen panel display 62 of FIG. 7. The pattern actuators 40F and 48F of FIG. 2 (and their corresponding components on the gauge side) establish a particular spiking pattern. For example, if one was spiking the front close hole of tie plate 30 in FIG. 2 and the rear close hole (close hole being one closest to the rail instead of remote from the rail), actuators 40F and 40S of FIG. 2 would be set such that lining up spiker 16F above its hole would automatically line up spiker 16S above the hole corresponding to it.

Block 72 leads to block 74 wherein the operator sitting in seat 24 of FIG. 1 manually controls the vehicle 10 until the box 18 (holding the hole sensing system or parts thereof) is generally over the tie plate 30 of FIG. 2. Upon the operator pressing the start button of control 60 (FIG. 7), block 76 follows block 74 and leads to block 78. At block 78, the search for holes is initiated.

At block 78, the present system advantageously momentarily turns off the laser and stores an image with the laser off. Then, the laser is turned on and an image is stored with the laser on and the difference between those two images is computed and stored and used to look for holes along the line of light between end points 54L1 and 54L2 (refer momentarily to FIG. 5). By using this image based upon the difference, any background light, which is independent of the laser, can be excluded from the data used for locating the holes.

The computer 59 of FIG. 7 uses the two dimensional set of digital data corresponding to this difference image for further processing at block 78. Any illuminated object appearing within the visual range of the camera is located. The size and position of these illuminated objects allows the computer to determine whether they are a visual representation of the surface of the tie plate and such data are processed further. Those which are not from the surface of the tie plate are rejected.

The data representing the objects can best be described as a set of illuminated points following generally along the line produced by the laser. These points are reduced to a line of essentially zero width representing the center line of the dataset. This set of points may have discontinuities at the holes and at the edges of the tie plate. Known signal processing techniques may be used to reduce an image to its centroid or central line. Preferably run-length filtering is used to obtain this central line, and various techniques can be used to minimize perturbation entry and exit at the beginning and end of the data set, respectively.

This filtering process provides a string of points equally spaced along the computed center line. Next, the processing starts at one end and determines the direction in which the next point lies (as in north, south, and all points in between). Each point is then tagged with this angle value. If these angle values are now sorted into a spectrum representing the angle distributions, the dominant directions and quantities of points can be extracted and used to decompose the objects into their elements, the parts lying parallel to the rail representing tie plate surface information.

A least-squares fitted line is made for each of the elements, and the end points representing the coordinance of the hole edges. This is then stored as a coordinate pairs representing the positions of the edges of the holes. By knowing the location of both edges of a hole, the computer can reject edges of the tie plate because the edges of the plate do not have a corresponding edge spaced approximately one hole width away.

Upon finding the two holes, now represented by four co-ordinant pairs, the computer has accurately determined reference points with a known position with respect to the visual frame of reference of the camera. Initially, the system is calibrated by placing a ruler on the tie plate with the field of view of the camera. This ruler has three marks, a known equal distance apart. The ruler is placed on the tie plate with the mark in the center approximately in the middle of the tie plate. For calibration, the video image of the calibrating ruler is transferred to a video screen, where a process similar to a mouse pointer allows the operator to identify the three points to the computer. Due to perspective distortion, the three calibration points are not depicted in their correct positional relationship. However, the computer knows by definition what these three points are and can determine parameters needed to express this relationship as a three-dimensional transformation equation, involving translation, rotation, and scaling in the x, y, and z axes.

The x dimension represents the distance along the track. The z dimension represents the view point distance (camera to object).

The spike driver can move forward and backward, and up and down. In the case where lateral movement is not needed under control of the computer program, the y dimension need not be used in the calculation because it has no effect.

Thus, the system calculates the locations of the tie plate hole edges along the track in relation to the position of the machine. As the spike holes are of known size, a small fixed adjustment indicates the center of the hole.

The computer senses the position of the spike driver in relation to the machine by reading the output of a potentiometer which is coupled to an electrically driven positioning ram 28A which moves the spike driver forward and backward in the rail direction. By use of this servosystem, correct positioning is obtained.

The computer calculates the distance and direction required to position the driver head over a selected hole, by summing or differencing the known position of the spike driver in relation to the machine and the apparent position of the hole in the field of view of the camera. Then, using an appropriate geometrical transform, calculates the desired true position and commands the servomechanism to move it there. The above mentioned position potentiometer then tells the computer when the desired position is reached, whereupon a signal is given to the operator that the spike may be driven as discussed below.

If for any reason whatsoever, the desired situation is not achieved, an error signal is generated telling the operator that the positioning process failed. This error signal illuminates a red, bad lamp shown on the operator's control box 60 of FIG. 7. If the processing performs properly, a green lamp corresponding to the okay in the operator's control box 60 is illuminated.

Next, block 80 tests to determine if one or two holes have been found. If not, the edge of the tie plate allows the system to determine which hole is found (if any) and to position and spike that hole. If no holes are found, control transfers to block 82 where the operator can manually position the spiker, followed by block 84 where the operator manually spikes the spikes. Control thus transfers from block 84 back to block 74.

Blocks 82 and 84 would only come into play in the unlikely event that two holes are not found. More likely, upon finding two holes, block 80, corresponding to computer 59 of FIG. 7 generating a FOUND signal, leads to block 86. Block 86 corresponds to the computer generating a sound or other sensory input perceived by the operator to indicate that the holes have been found or their positions determined. This leads to block 88 whereupon the computer 59 (refer back to FIG. 7) controls actuator 28A to position the spike head 16F over the appropriate hole which has been found.

Following the positioning at block 88, block 90 actually performs the spiking. This may be done by the operator pressing the okay or spike button in control panel 60 of FIG. 7. Alternately, if conditions allow the spikers to be positioned sufficiently accurately, the computer 59 of FIG. 7 may simply generate a spike signal at block 90 which initiates the spiking. Although not shown, the spiker 16F and spiker 16S may include position switches which signal the computer when the spike has been fully inserted in order to complete block 90.

Following block 90, block 92 tests whether all the desired spikes have been inserted in the particular tie plate. If not, control transfers back to block 88 which automatically positions the spiker or spikers for further spiking, preferably using feedback control of actuator 28A. Alternately, feedback control could be established of actuators 40F and 40S of FIG. 2 in order to get the next hole spiked in a particular tie plate.

If block 92 indicates that all the desired spikes have been spiked in a particular tie plate, control transfers back to block 74 for manually positioning the carriage 28 (by moving the vehicle) above the next tie plate. Although the coarse positioning could be performed by moving the vehicle, it could also be performed by manual control of the actuator 28A.

It should be noted that the process of FIG. 8 will be going on separately for the operators on the right and left side of the vehicle except that any manual coarse positioning at block 74 which involves movement of the vehicle will affect both sides of the vehicle.

Although various specific constructions and embodiments have been discussed herein, it is to be understood that these are for illustrative purposes only. Various modifications and adaptations will be apparent to those of skill in the art. Accordingly, the scope of the present invention should be determined by reference to the claims appended hereto.

What is claimed is:

1. A spiker vehicle comprising:

a vehicle frame with four rail engagement wheels;

a first spiker supported by said vehicle frame;

an actuator operably connected to said first spiker to move said first spiker in a rail direction; and a hole sensing system supported by said vehicle frame and operably connected to control said actuator so as to automatically move said first spiker into a spiking position above a spike hole in a tie plate on a tie of a railroad bed; and wherein said hole sensing system includes a laser operable to generate a beam and a beam spreader operable to spread the beam so as to apply a line of light having a sufficient length in a rail direction as to simultaneously illuminate two spike holes both on a given side of an adjacent rail, the two spike holes being offset in the rail direction on a tie plate, a detector for detecting light from the laser as reflected by a tie plate, and a hole recognizer connected to said detector for processing signals from said detector and generating a FOUND signal upon determining the locations of said two spike holes.

2. The spiker vehicle of claim 1 wherein said detector is a camera with a sufficient field of view to image two spike holes simultaneously with the edges of the tie plate.

3. The spiker vehicle of claim 2 wherein said beam spreader is operable to produce a fan beam.

4. The spiker vehicle of claim 3 wherein said laser and said detector are mounted to move in the rail direction with said first spiker under control of said actuator; and wherein said actuator moves said first spiker relative to said vehicle frame.

5. The spiker vehicle of claim 4 further comprising a first lateral positioner connected to said first spiker for moving said first spiker in a lateral direction perpendicular to the rail direction for selectively spiking spike holes adjacent a rail and spike holes remote from a rail.

6. The spiker vehicle of claim 5 wherein said first lateral positioner is operable for moving said laser and said detector in the lateral direction with said first spiker.

7. A spiker vehicle comprising:

a vehicle frame with four rail engagement wheels;

a first spiker supported by said vehicle frame;

an actuator operably connected to said first spiker to move said first spiker in a rail direction; and a hole sensing system supported by said vehicle frame and operably connected to control said actuator so as to automatically move said first spiker into a spiking position above a spike hole in a tie plate on a tie of a railroad bed; and wherein said hole sensing system includes a laser operable to generate a beam and a beam spreader operable to spread the beam so as to apply a line of light having a sufficient length as to simultaneously illuminate two spike holes on a tie plate, a detector for detecting light from the laser as reflected by a tie plate, and a hole recognizer connected to said detector for processing signals from said detector and generating a FOUND signal upon determining the location of two spike holes; and wherein said detector is a camera with a sufficient field of view to image two spike holes simultaneously with the edges of the tie plate; and wherein said beam spreader operable to produce a fan beam; and wherein said laser and said detector are mounted to move in the rail direction with said first spiker under control of said actuator; and wherein said actuator moves said first spiker relative to said vehicle frame; and further comprising a first lateral positioner connected to said first spiker for moving said first spiker in a lateral direction perpendicular to the rail direction for selectively spiking spike holes adjacent a rail and spike holes remote from a rail; and wherein said first lateral positioner is operable for moving said laser and said detector in the lateral direction with said first spiker; and further comprising a carriage support frame mounted to said vehicle frame, a carriage movably mounted to said support frame, and wherein said actuator is a carriage positioner for moving said carriage relative to said carriage support frame; and wherein said first spiker is movably mounted to said carriage; and further comprising a first spiker positioner connected to said first spiker to move said first spiker relative to said carriage.

8. The spiker vehicle of claim 7 further comprising a second spiker movably mounted to said carriage and a second spiker positioner connected to said second spiker to move said second spiker relative to said carriage, said first and second spikers mounted to spike on opposite sides of a rail; and wherein the length of the line of light extends sufficiently in a rail direction as to simultaneously illuminate two spike holes which are offset in the rail direction.

9. The spiker vehicle of claim 5 further comprising a spike button; and wherein said FOUND signal triggers a sensory output indicating that a human operator should activate the spike button such that spiking will occur.

10. The spiker vehicle of claim 5 wherein said FOUND signal automatically causes said first spiker to spike.

11. The spiker vehicle of claim 1 further comprising a spike button; and wherein said FOUND signal triggers a sensory output indicating that a human operator should activate the spike button such that spiking will occur.

12. The spiker vehicle of claim 1 wherein said FOUND signal automatically causes said first spiker to spike.

13. The spiker vehicle of claim 1 wherein said detector is a camera and said hole recognizer is a computer which images said line of light and recognizes where said line of light falls on holes.

14. A spiker vehicle comprising:

a vehicle frame with four rail engagement wheels;

a first spiker supported by said vehicle frame;

an actuator operably connected to said first spiker to move said first spiker in a rail direction relative to said vehicle frame; and a hole sensing system supported by said vehicle frame and operably connected to control said actuator so as to move said first spiker into a spiking position above a spike hole in a tie plate on a tie of a railroad bed; and wherein said hole sensing system includes an energy transducer and a hole recognizer for generating a FOUND signal upon determining the locations of two spike holes based on energy applied to said two spike holes from said energy transducer, said two spike holes being located on a given side of an adjacent rail, the two spike holes being offset in the rail direction.

15. The spiker vehicle of claim 14 further comprising a spike button; and wherein said FOUND signal triggers a sensory output indicating that a human operator should activate the spike button such that spiking will occur.

16. The spiker vehicle of claim 14 wherein said FOUND signal automatically causes said first spiker to spike.

17. The spiker vehicle of claim 14 wherein said energy transducer is a laser operable to generate a beam and a beam spreader operable to spread the beam so as to apply a line of light having a sufficient length in a rail direction as to simultaneously illuminate two spike holes offset in the rail direction on a tie plate, said hole sensing system further including a detector for detecting light from the laser as reflected by a tie plate, and a computer which images said line of light, recognizes where said line of light falls on holes, and generates said FOUND signal upon recognizing the holes.

18. A method of spiking tie plates to ties of a railroad track, the steps comprising:

moving a hole sensing system of a spiker vehicle to a hole sensing position for sensing holes in a tie plate on a tie;

simultaneously sensing the locations of two holes in said tie plate, by using an energy transducer applying energy to said two holes, said two holes being located on a given side of an adjacent plate holes both on a given side of an adjacent rail, the two spike holes being offset in a rail direction by operation of the hole sensing system;

automatically moving a first spiker in the rail direction to line up in a spiking position above one of said two holes sensed by the hole sensing system; and spiking said one of said two holes using said first spiker.

19. The method of claim 18 wherein said energy transducer is a laser.

20. The method of claim 19 wherein said automatically moving of said first spiker is accomplished by moving said first spiker relative to said spiker vehicle.

21. The method of claim 20 wherein said automatically moving of said first spiker is accomplished by moving a carriage on which said first spiker is mounted and on which a second spiker is mounted, said moving of the carriage automatically moving the second spiker into a spiking position lined up above a hole in the tie plate opposite said two holes.

22. The method of claim 21 wherein said spiking is performed automatically after the simultaneously sensing and automatically moving.

23. A spiker vehicle comprising:

a vehicle frame with four rail engagement wheels;

a first spiker supported by said vehicle frame;

an actuator operably connected to said first spiker to move said first spiker in a rail direction relative to said vehicle frame; and a hole sensing system supported by said vehicle frame and operably connected to control said actuator so as to move said first spiker into a spiking position above a spike hole in a tie plate on a tie of a railroad bed; and wherein said hole sensing system includes an electrical circuit having a detector and a hole recognizer connected to the detector for receiving signals therefrom, said hole recognizer generating a FOUND signal upon determining the locations of two spike holes, both on a given side of an adjacent rail and in a particular tie plate, said hole recognizer determining both said hole locations based on signals from said detector; and wherein said FOUND signal is operable to trigger a reaction selected from the group consisting of:

(1) a sensory output indicating that a human operator should activate a spike actuator such that spiking will occur; and (2) automatically causing said first spiker to spike.

24. The spiker vehicle of claim 23 further comprising a spike button; and wherein said FOUND signal triggers a sensory output indicating that a human operator should activate the spike button such that spiking will occur.

25. The spiker vehicle of claim 23 wherein said FOUND signal automatically causes said first spiker to spike.

* * * * *